United States Patent [19]

Toba

[11] Patent Number: 4,492,944

[45] Date of Patent: Jan. 8, 1985

[54] TRANSFORMER WINDING

[75] Inventor: Yasuo Toba, Hyogo, Japan

[73] Assignee: Mitsubishi Denki Kabushiki Kaisha, Tokyo, Japan

[21] Appl. No.: 540,455

[22] Filed: Oct. 7, 1983

[30] Foreign Application Priority Data

Oct. 8, 1982 [JP] Japan ..... 57-177881

[51] Int. Cl.[3] ..... H01F 15/14

[52] U.S. Cl. ..... 336/69; 336/70; 336/185; 336/206

[58] Field of Search ..... 336/69, 70, 60, 183, 336/185, 206

[56] References Cited

U.S. PATENT DOCUMENTS 3,781,739 12/1973 Meyer ..... 336/70

3,899,763 8/1975 Van Nice ..... 336/70

FOREIGN PATENT DOCUMENTS 567984 6/1958 Belgium ..... 336/70

216230 11/1941 Switzerland ..... 336/69

836271 6/1960 United Kingdom ..... 336/69

*Primary Examiner*—A. D. Pellinen

*Assistant Examiner*—Susan A. Steward

*Attorney, Agent, or Firm*—D. R. Lackey

[57] ABSTRACT

A transformer winding characterized by a plurality of electrically connected disc or pancake coils disposed around a core leg in which the inner and outer edges of adjacent coil pairs are radially offset, enabling the insulative members which surround the edges of each such coil pair to be curved and thus more closely conform to the equipotential planes of the dielectric field.

2 Claims, 4 Drawing Figures

TRANSFORMER WINDING

BACKGROUND OF THE INVENTION

1. Field of the Invention

This invention relates to transformer windings and, more particularly, to a disposition of disc or pancake coils on a magnetic core.

2. Description of the Prior Art

The windings of some conventional transformers, such as the type comprising pancake coils, have the inner and outer peripheral edges of adjacent coils disposed within insulative channel members that are in the path of the equipotential lines of the dielectric field. Thus, voltage differences occur across the surfaces of the channel members, and the resulting dielectric strength of the transformer is diminished due to the resulting high creep stresses at the edges of the coils.

SUMMARY OF THE INVENTION

It has been found that the windings of a transformer may be improved by providing a plurality of axially spaced, serially connected pancake coils in which pairs of adjacent coils have their peripheral edges which are associated with mutually connected coil ends disposed within an insulative channel member, with these peripheral edges being radially stepped or offset from one another. This enables the insulative channel members to be constructed with a curved surface which conforms with the adjacent edges of the stepped coils, and which more closely follows the paths of the equipotential lines or planes. The curved or contured insulative channel members improve the dielectric strength of the insulation system by substantially reducing creep stresses and by working the insulation in puncture, its strongest characteristic.

DESCRIPTION OF THE PREFERRED EMBODIMENT

Figure 1:
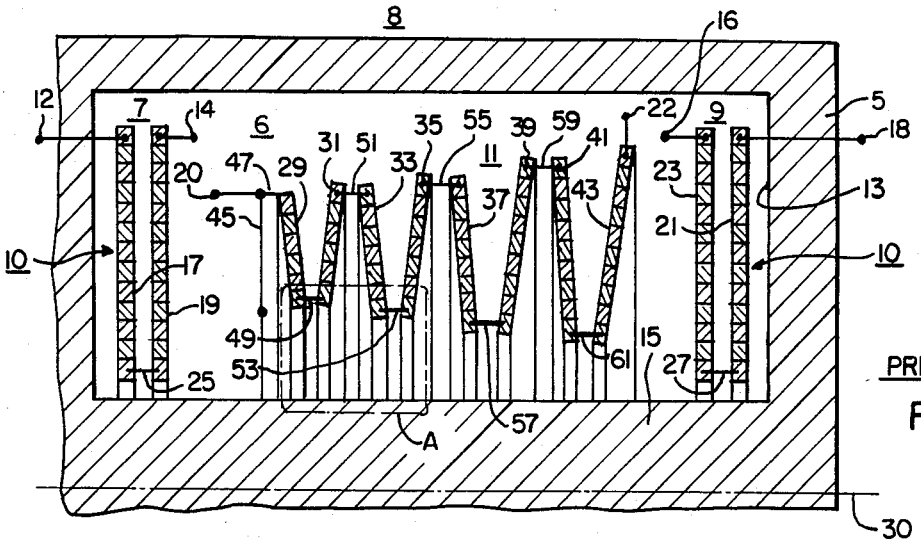
PRIOR ART FIG. 1.
FIG. 1 is a fragmentary sectional plan view taken through a coil-core assembly of a transformer of prior art construction.
Figure 2:
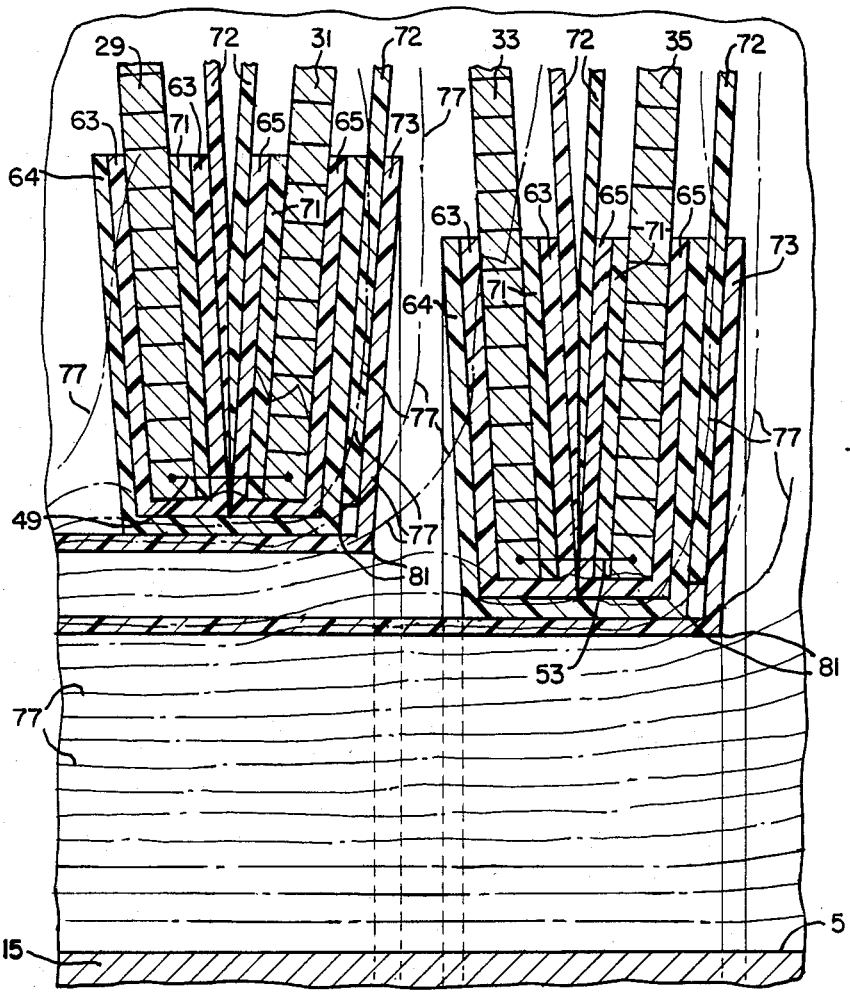
PRIOR ART FIG. 2.
FIG. 2 is an enlargement of area A of FIG. 1.

In FIGS. 1 and 2 an exemplary coil-core assembly 6 for a transformer 8 of prior art construction is shown. Transformer 8 includes a magnetic core 5, sections 7 and 9 of a primary winding 10, and a secondary winding 11. Primary winding 10 includes terminals 12, 14, 16 and 18 for interconnecting the sections, and for connection to low voltage bushings on a transformer tank (not shown). Secondary winding 11 includes a terminal 20 for connection to a high voltage bushing on the transformer tank (not shown), and a terminal 22 which may be connected to a bushing adapted for connection to the neutral of a polyphase electrical power system. The core 5 comprises a window 13 defined by leg portions of the core, including a winding leg 15. Windings 10 and 11 and magnetic core 5 are symmetrical about winding axis or centerline 30.

The primary and secondary windings 10 and 11 are each constructed of axially spaced disc or pancake coils which encircle the winding leg 15 about the centerline 30. Primary winding section 7 includes a plurality of axially spaced coils, such as coils 17 and 19, and primary winding section 9 also includes a plurality of spaced coils, such as coils 21 and 23. Coils 17 and 19 have their inner ends electrically interconnected at 25 and coils 21 and 23 are similarly interconnected at 27.

The secondary winding 11 includes a plurality of "dished" pancake coils such as coils 29, 31, 33, 35, 37, 39, 41, 43, which are axially spaced and disposed substantially parallel to each other in the recited order between the spaced primary winding sections 7, 9. An electrostatic plate 45 is disposed at the line end of winding 11, and it is connected to terminal 20 and thus to the line end pancake coil 29. Adjacent coils 29 through 43 have their inner and outer ends electrically interconnected to connect the coils in series, via connections 49, 51, 53, 55, 57, 59 and 61, between terminals 20 and 22. The dished pancake coils are alternately arranged such that the coil edges associated with the mutually connected ends of adjacent coils are spaced closely together and their edges associated with their unconnected ends are spaced relatively far apart, to electrically grade the insulation according to the electrical stress which will be developed between them when the winding is energized. In other words, the convex sides of adjacent coils face one another, and the concave sides of adjacent coils face one another. Connections 49, 53, 57 and 61, which interconnect inner coil ends, are referred to as "start-start" connections, and connections 51, 55 and 59, which interconnect outer coil ends, as "finish-finish" connections.

The mutually connected inner and outer ends of the coils have their associated inner and outer peripheral edges insulated in a similar manner, and thus only the insulating structure of the inner coil edges will be described in detail. As shown more particularly in FIG. 2 the inner peripheral portions or edges of each pair of coils, such as coils 29 and 31, and coils 33 and 35, are insulated in a similar manner, with like reference numerals being used to identify similar items of the structure. Insulating channel members 63 and 65 are disposed about the inner edges of each coil of a pair. Various insulating spacer members 71 and insulating washer members 72 are disposed between the coils and channel members, to properly space the coils while providing the necessary ducts for flow of an insulating and cooling liquid, such as mineral oil. An insulating channel member 64 is disposed about both inner edges of each coil pair, and additional insulating channel or angle members, such as member 73, are added to provide the required spacing between the coil edges and the magnetic core 5.

The equipotential lines 77, which are perpendicular to the electric or dielectric field, bend rather sharply and concentrate adjacent to the inner and outer edges of the pancake coil of each coil pair which is on the neutral end side of the pair. Thus, the equipotential lines 77 cross the corners 81 of the insulative members, resulting in a large voltage gradient across their surfaces and high creep stresses.

Figure 3:
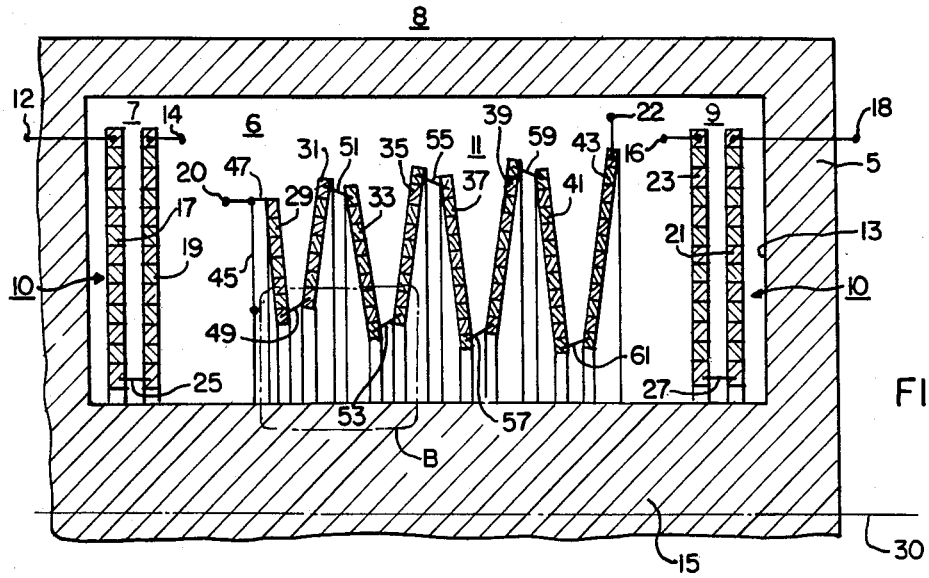
FIG. 3 is a fragmentary sectional view through a coil-core assembly of a transformer in accordance with this invention.
Figure 4:
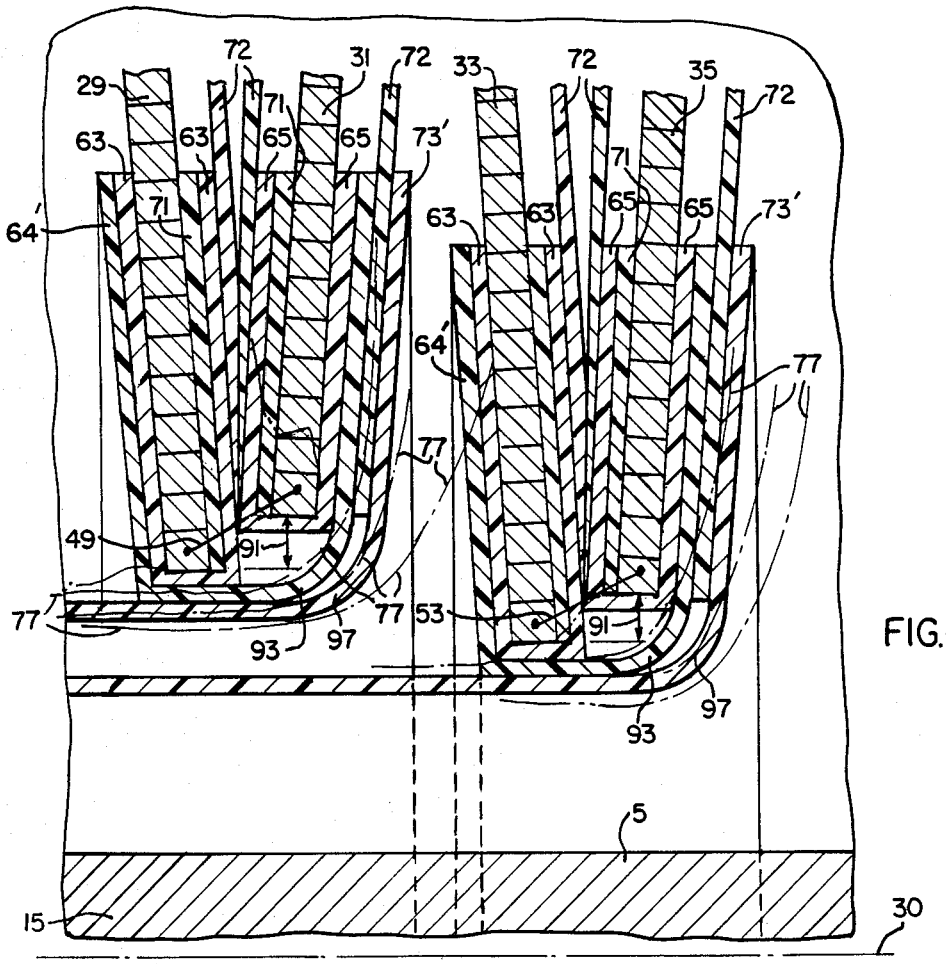
FIG. 4 is an enlargement of area B of FIG. 3.

In accordance with this invention, the disadvantage of the prior art construction of FIGS. 1 and 2 is avoided by the structure shown in FIGS. 3, 4. For simplicity of description, similar numbers are used for similar parts of FIGS. 1, 2. Similar but modified structures include a prime mark. To avoid the high creep stresses generated as set forth with reference to FIG. 2, the inner and outer edges of each adjacent pair of coils across the winding are radially stepped or offset from one another by a distance indicated by arrows 91 (FIG. 4). When viewing the start-start connections 49 and 53 at the inner edges of the coils, the edge of the coil on the neutral side of each pair, i.e., coils 31 and 35, steps radially outward from centerline 30 by the dimension 91, when compared with the inner edge of the line end coil of the pair. In like manner, when viewing the finish-finish connection 51 (FIG. 3) of the coil pair which includes coils 31 and 33, the edge of coil 33, which is on the neutral side of the pair, steps radially inward, towards centerline 30.

Thus, the insulative channel and angular members of the prior art, such as members 64 and 73, no longer require sharp corner bends and may be constructed as shown in FIG. 4 wherein members 64' and 73' include smoothly curved portions 93 and 97 respectively. The curved portions 93 and 97 extend between the edges of associated coil pairs, and more closely conform to the equipotential lines 77, while performing their required functions of mechanically holding and electrically insulating the coil edges. By providing larger effective radii for the insulative channel and angle members, as they smoothly change from a portion which is parallel with the centerline 30 to a portion which is substantially perpendicular to centerline 30, the potential gradient across the surfaces of these insulative members is substantially reduced, which reduces creep stresses accordingly.

I claim as my invention:

1. A transformer, comprising:

a magnetic core having two windows separated by a winding leg having a longitudinal axis, an electrical winding disposed about said winding leg, said electrical winding having first and second ends, and a winding axis which extends between its ends, with said winding axis being coaxial with the longitudinal axis of said winding leg, said electrical winding including a plurality of pancake coils each having inner and outer ends and inner and outer peripheral edges, with portions of said inner and outer peripheral edges being adjacent to core portions, devoid of any intervening electrical winding, said plurality of pancake coils being arranged in pairs, means electrically interconnecting the inner ends of the pancake coils of each pair via start-start, connections, means electrically interconnecting the outer ends of the adjacent pancake coils of adjacent pairs via finish-finish connections, the inner edges of each coil pair being radially offset from one another, and the outer edges of the adjacent pancake coils of adjacent coil pairs being radially offset from one another;

first insulative channel members disposed about the radially offset inner edges of each coil pair, and second insulative channel members disposed about the radially offset outer edges of the adjacent pancake coils of adjacent coil pairs, each of said first and second insulative members including a smoothly curved portion which extends between the edges of the associated pancake coils, resulting in the surfaces of said curved portions closely conforming to the equipotential planes of the dielectric field which exists adjacent to the inner and outer edges of the pancake coils.

2. The transformer of claim 1 including a high voltage terminal and a neutral terminal, with the pancake coil at one axial end of the winding being connected to the high voltage terminal, and with the pancake coil at the other axial end of the winding being connected to the neutral terminal, and wherein the radially offset peripheral inner edges of the pancake coils of each coil pair are arranged such that the inner peripheral edge of the coil of each coil pair which faces the neutral end of the winding steps radially outward with respect to the winding axis, and the radially offset peripheral outer edges of the adjacent coils of adjacent coil pairs are arranged such that the outer peripheral edges of the coils which face the neutral end of the winding step radially inward with respect to the winding axis.

* * * * *